US006112438A

United States Patent [19]

Weagley

[11] Patent Number: 6,112,438

[45] **Date of Patent: *Sep. 5, 2000**

[54] SNOW PLOW

[75] Inventor: Michael P. Weagley, Rush, N.Y.

[73] Assignee: Pro-Tech Welding & Fabrication, Inc., Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/134,765

[22] Filed: Aug. 14, 1998

[51] Int. Cl.[7] ..... E01H 5/06; E02F 3/80; E02F 3/76

[52] U.S. Cl. ..... 37/270; 37/266; 37/274; 172/393; 172/832; 172/701.1

[58] Field of Search ..... 37/266, 274, 281, 37/270; 172/684.5, 701.1, 815, 298, 387, 393, 832

[56] References Cited

U.S. PATENT DOCUMENTS

| | | | |
|---|---|---|---|
| 1,373,799 | 4/1921 | Conley | 172/393 |
| 1,581,414 | 4/1926 | Young | 172/393 |
| 2,078,636 | 4/1937 | Kuchar | 172/832 |
| 4,019,268 | 4/1977 | Waterman | 172/815 |
| 4,723,609 | 2/1988 | Curtis | 172/815 |
| 4,779,363 | 10/1988 | Boutrais et al. | 37/117.5 |
| 5,638,618 | 6/1997 | Niemel et al. | 37/281 |
| 5,655,318 | 8/1997 | Daniels | 37/231 |
| 5,819,444 | 10/1998 | Desmarais | 37/281 |

*Primary Examiner*—Eileen Dunn Lillis
*Assistant Examiner*—Gary S. Hartmann

[57] ABSTRACT

A snow plow includes a central blade and left and right end blades pivotally connected to the ends of the central blade for movement between open positions in line with the central blade, and folded positions forward of the central blade. The rear of the central blade includes a horizontal slot for removable insertion of a loader bucket to lift and drive the plow. Side walls extend forward from the outer end of each end blade, each side wall including a removable wear shoe for sliding contact on a ground surface. The end blades are lockable in both their open and folded positions.

4 Claims, 3 Drawing Sheets

SNOW PLOW

BACKGROUND OF THE INVENTION

This invention is a snow plow for use on large areas such as parking lots and airport runways, hereinafter referred to as a "wide snow plow".

A "wide snow plow" is wider than a snow plow used on streets and roads. Mounted on the bucket of a front end loader (its ordinary operating position), a wide snow plow cannot be driven from one site to another. In order to use such a plow at more than one site, it must be transported from place to place on a flatbed trailer.

U.S. Pat. No. 5,724,755 was issued to me on Mar. 10, 1998. A snow plow disclosed there includes a blade with horizontal and vertical reinforcing channels, a removable rubber edge fastened to the blade and extending below its bottom edge, and a side plate extending forward from each end of the blade. Side plates each include a removable wear shoe with inclined ramps for sliding contact on the ground surface. Upper and lower rows of posts extend rearward from the blade to form a slot for insertion of a front end loader bucket. The full disclosure of that earlier patent is incorporated herein by reference. The present invention includes elements of that system.

U.S. Pat. No. 4,723,609 is the most relevant prior art that I know of. It discloses a scraper (or plow) including a central blade member with end blade members pivotally connected on each end. The end blades are pivotable on the central blade to enclose or to grip a load or, with the addition of a bottom plate, to form a bucket.

An object of this invention to provide a wide snow plow which is foldable from an open configuration for use, to a closed configuration for road travel while still mounted on a front end loader.

SUMMARY OF THE INVENTION

A snow plow of this invention includes a central blade and left and right end blades pivotally connected to the ends of the central blade for movement between open positions in line with the central blade, and folded positions forward of the central blade. The rear of the central blade includes a horizontal slot for removable insertion of a loader bucket to lift and drive the plow. Side walls extend forward from the outer end of each end blade, each side wall including a removable wear shoe for sliding contact on a ground surface. The end blades are lockable in both their open and folded positions.

DETAILED DESCRIPTION

Figure 1:
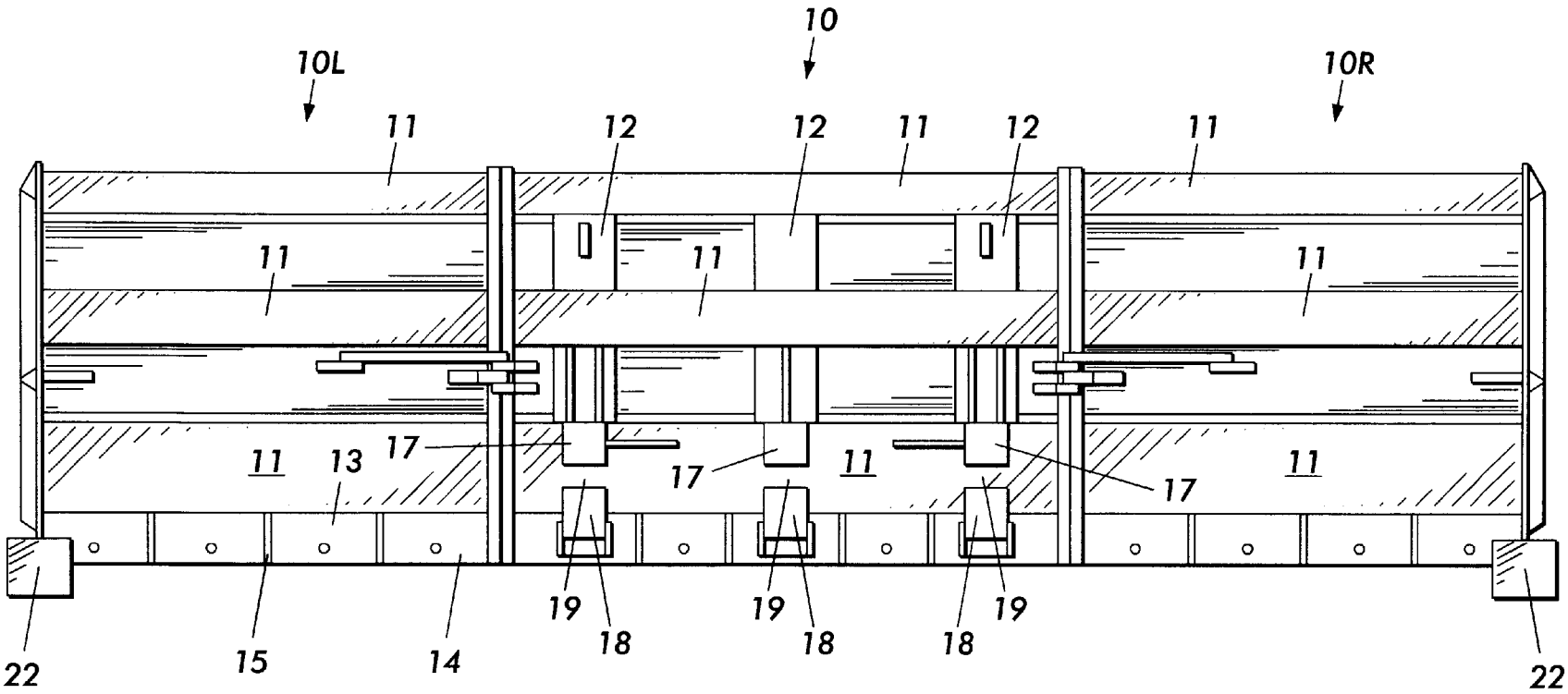
FIG. 1 is a rear elevation view of the snow plow of this invention.

In FIG. 1, my snow plow includes an upstanding central blade 10, and left and right end blades 10L, 10R pivotally connected to left and right ends respectively of the central blade 10. Vertical side walls 20 extend forward from the outer ends of the end blades 10L, 10R.

The back of each of the blades 10, 10L, 10R includes horizontal reinforcing channels 11 welded across its width, and a backing flat stock member 13 behind and along the length of its bottom edge. Reinforcing gussets 15 are spaced along the backing members 13. The central blade 10 further includes vertical reinforcing channels 12 welded between its horizontal channels 11.

A resilient rubber edge 16 (FIG. 3) is removably mounted along the bottoms of the blades 10, 10L, 10R to extend below their steel edges 14. The rubber edges 16 are adjustable and reversible to accommodate for wear.

The blade 10 (FIGS. 1 and 2) includes an upper horizontal row of three posts 17, and a lower horizontal row of three posts 18, extending out from the lowermost horizontal channel 11 on the back of the blade. The posts are rectangular in cross section. The two rows of posts 17, 18 form a horizontal slot 19 between them. The bucket of a front end loader fits into the slot 19 to engage the blade 10. Installation of the plow on (and removal from) the loader bucket is quick and easy.

The side walls 20 (FIGS. 4 and 5) each include a removable wear shoe 21 with a bottom runner 22 for sliding contact with the ground surface. The bottom runners 22 include front and back 45° ramp surfaces for easy riding over surface irregularities. The wear shoes 21 are "sacrificial" members of the snow plow. They are bolt mounted for replacement when necessary.

The wear shoes 21 provide a clearance between ground level and the steel edge 14 of the plow. The rubber edge 16 extends below the steel edge 14 to act like a "squeegee" on the ground surface, but does not bear the weight of the apparatus. The rubber edge 16 is flexible enough to glide over many surface irregularities without gouging asphalt, concrete, or tar-gravel. It also rides easily over grates, manhole covers, and other such potential hazards, permitting higher speed and damage-free snow removal.

Figure 2:
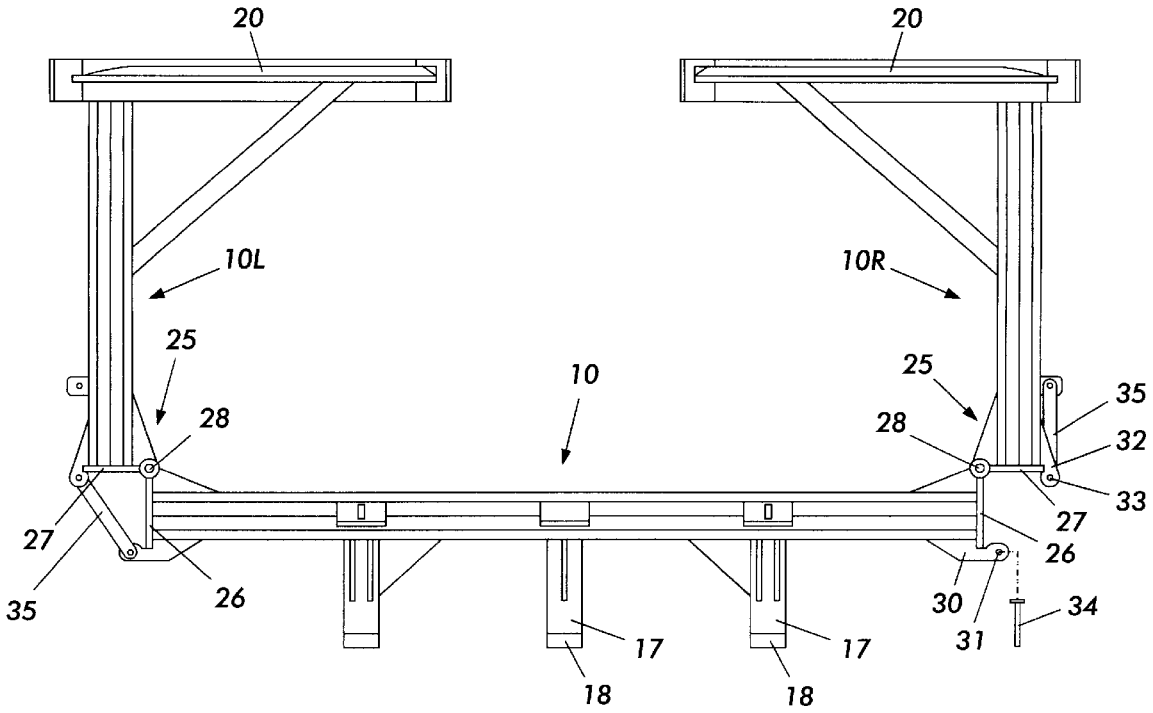
FIG. 2 is a top view of the snow plow of FIG. 1.
Figure 4:
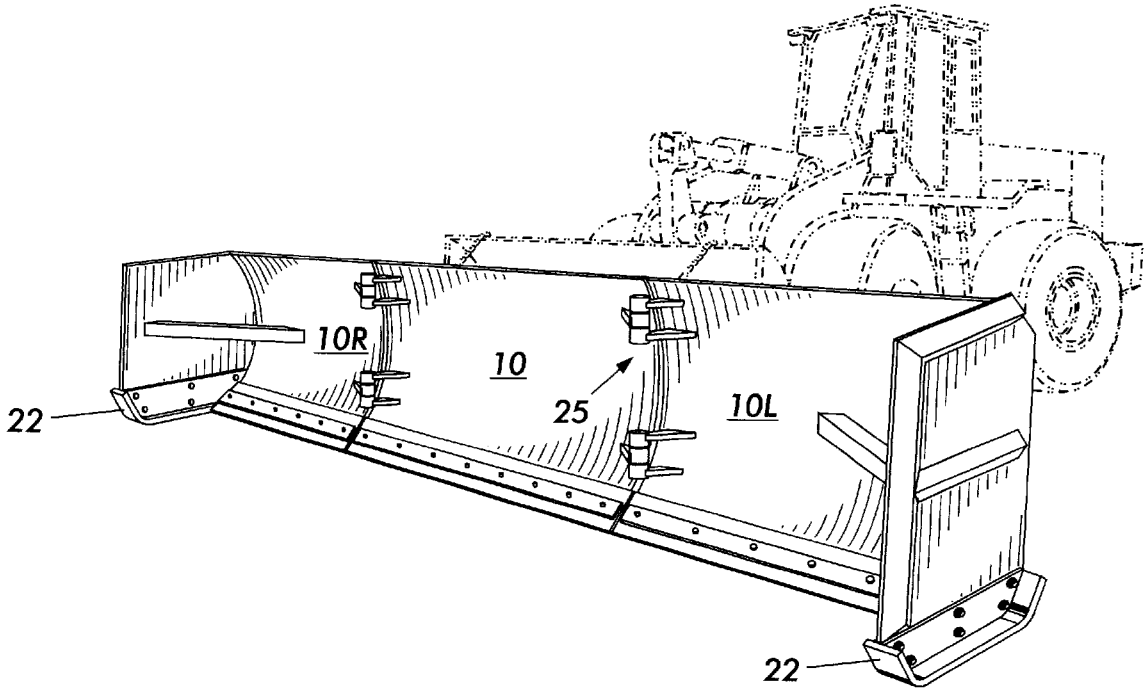
FIG. 4 is a pictorial view of the snow plow in its open configuration.
Figure 5:
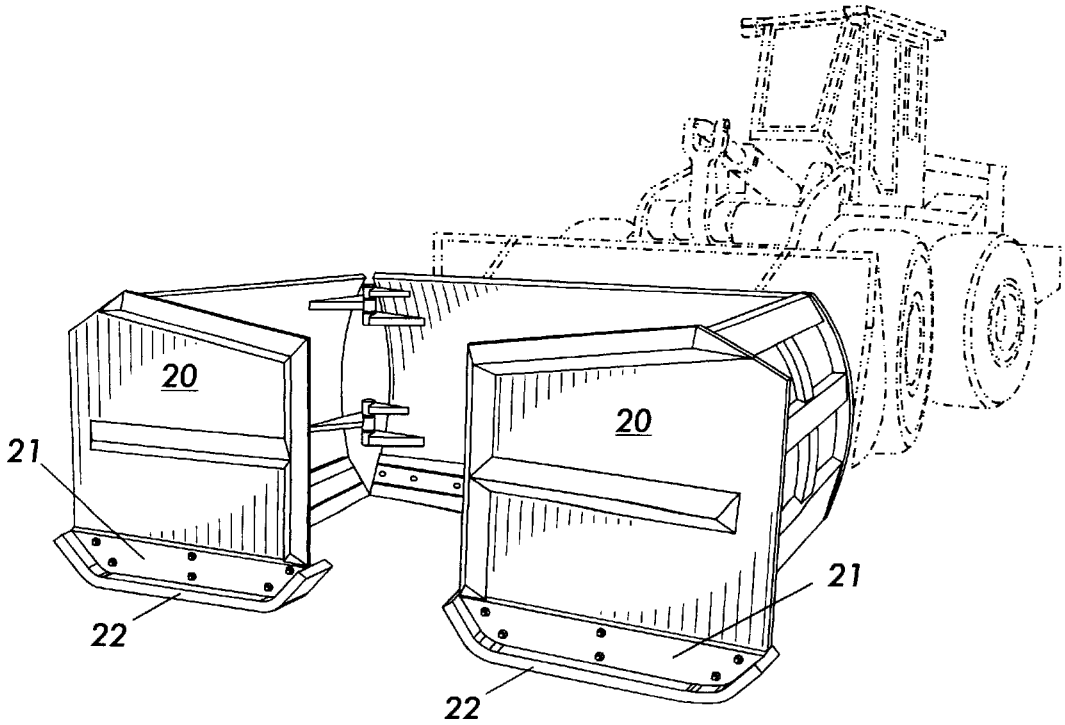
FIG. 5 is a pictorial view of the snow plow in its folded configuration.

As best shown in FIG. 2, the left and right end blades 10L, 10R are mounted on the central blade 10 by hinges 25 for pivotal movement between a closed or folded configuration (FIG. 2) and an open or straight configuraton (FIG. 4).

The central blade 10 includes a vertical hinge plate 26 at each end. The end blades 10L, 10R each include a vertical hinge plate 27 on its inner end. A hinge pin 28 connects the mating hinge plates 26, 27 to complete the hinge connection of end blades 10L, 10R to the central blade 10.

The hinged connections between blades 10 and 10L, and between blades 10 and 10R, further include means to lock them in their open and closed configurations. The central blade 10 includes at each end a lug 30 with a vertical pin hole 31 for a locking pin. The end blades 10L, 10R each similarly include at its inner end a lug 32 with a vertical pin hole 33.

In the open or straight configuration of the plow, shown in FIG. 1, the pin holes 31, 33 are aligned and their respective lugs 30, 32 secured together by a pin 34 through the aligned holes.

In the closed or folded configuration of the plow, shown in FIG. 2, the lugs are spaced apart and are secured in that condition by a brace 35 which is connected to lugs 30 and 32 by pins 34. Pins 34 are removable for locking and unlocking these hinged connections for the purpose of changing from one plow configuration to the other. For illustration, FIG. 2 shows one brace 35 appropriately connected, and the other in a disconnected or rest position.

Figure 3:
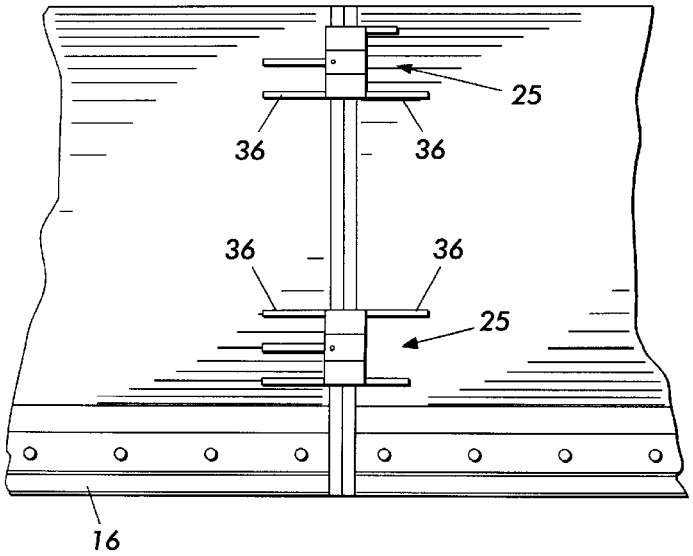
FIG. 3 is a detail front elevation view of the snow plow of FIG. 1.

FIGS. 2 and 3 further show gussets 36 to strengthen the structural connection of the plow blades 10, 10L, 10R.

Pivotal movement of the end blades relative to the central blade between open and closed configurations is substantially 90° as shown, but it might be greater than 90° if it is desired to form a more compact arrangement for transport.

In this description, "ground surface" is intended as a convenient term to include any surface such as road, parking lot, runway, or the like where this snow plow is to be used. Similarly, "rubber" is intended to include the entire range of rubbers or elastomers suitable for the use described herein.

Some details of the snow plow which are not essential to an understanding of this invention are more fully described in the above-referenced U.S. Pat. No. 5,724,755.

The foregoing description of a preferred embodiment of this invention, including any dimensions, angles, or proportions, is intended as illustrative. The concept and scope of the invention are limited only by the following claims and equivalents thereof.

What is claimed is:

1. A snow plow, including:

an upstanding central blade;

upper and lower rows of posts extending horizontally rearward from said central blade, said upper and lower rows of posts defining between them a horizontal open slot for removable insertion therein of driving means to lift and push said plow;

left and right end blades pivotally connected to corresponding ends of said central blade for movement relative to said central blade between open positions substantially in line with said central blade, and folded positions forward of and substantially normal to said central blade;

a reversible rubber edge removably fastened to each of said blades and extending along and below the bottom edge thereof;

a vertical side wall extending forward at a right angle from the outer end of each of said end blades, said side walls each including a removable longitudinal runner along the bottom of said wall, said runners having inclined front and rear ramp surfaces for sliding contact on a ground surface, said runners effective to provide clearance space under the bottom edges of said blades; and locking means to lock said end blades in said open positions and in said folded positions.

2. A snow plow as defined in claim 1, said locking means including:

a first apertured lug on each end of said central blade;

a second apertured lug on the inner end of each of said end blades;

a locking pin to lock adjacent first and second lugs together in said open position; and a brace to hold said adjacent first and second lugs apart in said folded position.

3. A snow plow, including:

an upstanding central blade;

an upper row of posts projecting horizontally rearward from said central blade, and a lower row of posts projecting horizontally rearward from said central blade;

said upper and lower rows of posts defining between them a horizontal open slot for removable insertion therein of a horizontal edge of driving means to lift and push said plow;

left and right end blades pivotally connected to corresponding ends of said central blade for movement relative to said central blade between open positions substantially in line with said central blade, and folded positions forward of and substantially normal to said central blade;

a reversible rubber edge removably fastened to each of said blades and extending along and below the bottom edge thereof;

a vertical side wall extending forward at a right angle from the outer end of each of said end blades, said side walls each including a wear shoe removably mounted thereon, said wear shoes each including a bottom longitudinal runner with inclined front and rear ramp surfaces for sliding contact on a ground surface, said runners effective to provide clearance space under the bottom edges of said blades; and locking means to lock said end blades alternatively in said open positions and in said folded positions.

4. A snow plow as defined in claim 3, said locking means including:

a first apertured lug on each end of said central blade;

a second apertured lug on the inner end of each of said end blades;

a locking pin to lock adjacent first and second lugs together in said open position; and a brace to hold said adjacent first and second lugs apart in said folded position.

* * * * *